US005302216A

United States Patent [19]

Sugita et al.

[11] Patent Number: 5,302,216

[45] Date of Patent: Apr. 12, 1994

[54] METHOD FOR PRODUCING BY CONTINUOUS HEAT TREATMENTS OIL-TEMPERED STEEL WIRES FOR SPRINGS HAVING HIGH STRENGTH AND HIGH TOUGHNESS

[75] Inventors: Heiji Sugita, Ichikawa; Yoshitaka Nitta, Yachiyo; Masao Toyama, Minoo; Hiroharu Sawada, Ichikawa, all of Japan

[73] Assignee: Sugita Wire Mfg. Co., Ltd., Tokyo, Japan

[21] Appl. No.: 866,016

[22] Filed: Apr. 8, 1992

[30] Foreign Application Priority Data

Apr. 10, 1991 [JP] Japan ..... 3-104806

[51] Int. Cl.[5] ..... C21D 9/02

[52] U.S. Cl. ..... 148/595; 148/908; 148/580

[58] Field of Search ..... 148/908, 595, 580

[56] References Cited

U.S. PATENT DOCUMENTS 2,441,628 5/1948 Griffiths et al. .
3,223,562 12/1985 Bassett, III .
4,174,981 11/1979 Cassell .

FOREIGN PATENT DOCUMENTS 2461009 1/1981 France .
156229 7/1987 Japan ..... 148/595
63-109144 5/1988 Japan .
63-216951 9/1988 Japan .
238220 10/1988 Japan ..... 148/595
64-4578 1/1989 Japan .
2-133518 5/1990 Japan .
322382 11/1971 U.S.S.R. ..... 148/595
1267832 3/1972 United Kingdom .

OTHER PUBLICATIONS

Haerterei Technische Mitteilungen, vol. 41, No. 2, pp. 61–65 (Mar. 1986).
Steel In the U.S.S.R., vol. 19, No. 3, pp. 126–128 (Mar. 1989).

*Primary Examiner*—Deborah Yee
*Attorney, Agent, or Firm*—Armstrong, Westerman, Hattori, McLeland and Naughton

[57] ABSTRACT

Disclosed herein is a new method for continuous heat treatment to be applied to the production of oil tempered steel wires for springs having high strength and high toughness to meet the requirement for weight reduction.

The heat treatments are applicable to a medium carbon low alloy spring steel which does not undergo martensitic transformation substantially upon oil hardening alone. It comprises performing two-step accelerated hardening consistin of oil hardening and immediately following water hardening and subsequently performing tempering. The medium carbon low alloy steel is one which consists 0.40–0.65% carbon and Si and Mn as essential components and further at least one species of Cr, Ni, Mo, and V, and have the chemical composition corresponding to and Mf point lower than 80° C. (preferably 10°–70° C.). It is desirable that the oil be wiped from the steel wire after the oil hardening and before the water hardening.

4 Claims, No Drawings

METHOD FOR PRODUCING BY CONTINUOUS HEAT TREATMENTS OIL-TEMPERED STEEL WIRES FOR SPRINGS HAVING HIGH STRENGTH AND HIGH TOUGHNESS

BACKGROUND OF THE INVENTION

1. Field of the Invention

The present invention relates to a method of producing oil-tempered steel wires for springs. More particularly, the present invention relates to a method for producing, by continuous heat treatments, oil-tempered steel wires for springs (such as coil springs) having high strength and high toughness.

2. Description of the Prior Art

The production of springs from oil-tempered steel wires involves a series of continuous heat treatments (including oil hardening and oil tempering in a salt bath) of steel wires and the subsequent forming (secondary operation) of the tempered steel wires into springs. An alternative production method starts with the hot forming of steel wires into springs, which is followed by continuous heat treatments including oil hardening and oil tempering.

The reason why the oil hardening is employed is that steel wires for springs are selected from SUP6, SUP7 (Si steel wire: 0.56–0.64% C), and SUP12 (Si-Cr steel wire: 0.51–0.59% C) provided in JIS 4801, which are susceptible to quenching cracking in the case of water hardening. In addition, the oil hardening and oil tempering are carried out one after the other for improved productivity.

In general, hardening denotes a series of steps of keeping steel at a temperature higher than the $Ac_3$ transformation point, thereby causing carbides in the steel to form solid solution and forming the austenite structure, and quenching the steel with a cooling medium, thereby forming the martensite structure. Quenching often causes troubles such as quenching strain and quenching crack, depending on the cooling medium used. Several countermeasures, as given below, have been proposed.

(1) Using as the quenching medium a mineral oil which is incorporated with various additives so that an adequate relationship is established between the cooling temperature and cooling time for the specific requirements of quenching. The quenching oil should be used at about 80° C. in consideration of its viscosity and other factors.

(2) Using a recently developed quenching medium which is an aqueous oil emulsion which exhibits a performance similar to that of quenching oil. However, in the case of rapid cooling from high temperatures to normal temperature, it brings about an imbalance between shrinkage strain due to cooling and expansion strain due to martensitic transformation. This imbalance of strains leads to quenching cracks. Common practice to eliminate this disadvantage is to remove the steel from the bath when the quenching medium is hotter than normal temperature or when the steel is still at a high temperature.

(3) Using a new quenching method which improves the low-temperature toughness of high tensile strength steel in the form of thick plate (not in the form of wires for springs). It consists of two steps of quenching to produce the controlled quenching effect using the same quenching medium (water). It may be referred to as "two-step slow quenching method".

Meanwhile, recent attempts to reduce the weight of automobiles has led to the development of high-stress springs. They need a high-strength steel wire which has the property that it does not deteriorate appreciably in toughness when it is imparted high strength. In general, the higher it is in strength, the lower it is in toughness. A possible way to compromise these two properties with each other is to reduce the carbon content in the steel and incorporate steel with a variety of alloy elements for the desired hardenability.

Conventional tempered steel wires for springs are produced by continuous heat treatment including oil hardening and tempering. In the case of a high-carbon steel containing a small amount of alloy elements, oil hardening alone will be satisfactory and even somewhat incomplete oil hardening gives rises to a desired strength. However, this does not hold true of a low-carbon steel containing a large amount of alloy elements, which is intended for high strength and high toughness through hardening as mentioned above. In this case, oil hardening alone does not produce the desired hardening effect, with the result that the springs in tempered state do not have both high toughness and high strength (2000 $N/mm^2$ and above).

SUMMARY OF THE INVENTION

The present invention was completed to meet the above-mentioned requirements for steel wires. Accordingly, it is an object of the present invention to provide a method for producing by continuous heat treatments (oil tempering) oil-tempered steel wires for springs which have both high toughness and high strength.

The recent trend in weight reduction has aroused a need for high-strength spring steels. Attempts to meet this need are being made by increasing the amount of alloy elements or adding new alloy elements. However, these attempts are not successful because such new steels do not give rise to sufficient martensite structure when they undergo the conventional oil hardening.

With the foregoing in mind, the present inventors carried out a series of researches on the method of performing continuous heat treatments for the satisfactory quenching effect without quenching cracking in the production of oil-tempered steel wires for springs having both high strength and high toughness, the steel being a medium carbon low alloy steel having an improved hardenability.

As the result, it was found that such a new steel has high strength if it undergoes two-step hardening which consist of a primary step of oil hardening (in the conventional manner) and a secondary step of cooling at a low temperature (below normal temperature). The primary step is to perform rapid cooling for the critical zone and slow cooling for the dangerous zone, in order that there will be a minimum of difference in temperature (and hence strain) between the inside and outside. The secondary step promotes the transformation of residual austenite into martensite. The result is that the tempered steel has a stable martensite structure with a minimum of difference in strain between the inside and outside.

In short, the present invention is embodied in an improved method for producing oil-tempered steel wires for springs having high strength and high toughness by performing hardening and tempering continuously from a medium carbon low alloy spring steel which does not undergo martensitic transformation substantially upon oil hardening alone, wherein said improvement comprises performing two-step accelerated hardening consisting of oil hardening and immediately following water hardening and subsequently performing tempering.

BRIEF DESCRIPTION OF THE INVENTION

The method of the present invention is applied to a specific steel from which oil-tempered steel wires for springs are produced. This steel is a medium carbon low alloy steel which does not undergo martensitic transformation substantially upon oil hardening alone.

As mentioned above, the conventional quenching medium for oil hardening is designed to be used at about 80° C. because of its viscosity and other restricting factors. With this quenching medium, it is impossible to achieve the complete martensitic transformation in the case where the steel has the chemical composition which corresponds to an Mf point (the temperature at which the martensitic transformation finishes) lower than 80° C. The medium carbon low alloy steel which does not undergo the martensitic transformation completely upon oil hardening alone may be defined as a steel which has an Mf point lower than 80° C. (more specifically from 10° C. to 70° C.).

The medium carbon low alloy steel from which high strength, high toughness springs can be produced includes those which contain carbon in a medium amount (0.40–0.65%), Si and Mn as essential components, and at least one element selected from Cr, Ni, Mo, and V.

The Mf point of a steel can be calculated from the known formula as given below.

$$Mf = 285 - 333 \times C\,(\%) - 34 \times Mn\,(\%) - 35 \times V\,(\%) - 20 \times Cr\,(\%) - 17 \times Ni\,(\%) - 11 \times Mo\,(\%) - 10 \times Cu\,(\%) - 5 \times W\,(\%) + 15\,Co\,(\%) + 30 \times Al\,(\%).$$

When the above-mentioned spring steel undergoes the conventional continuous heat treatments consisting of oil hardening and tempering, it becomes composed mostly of martensite and partly of residual austenite. Upon tempering, the martensite transforms into sorbite; however, the residual austenite partly remains unchanged and partly transforms into bainite. The resulting steel does not have satisfactory toughness and fatigue resistance, and hence it inevitably lacks high strength.

The foregoing does not hold true of the continuous heat treatment of the present invention, because the two-step hardening gives rise to only a limited amount (less than 10%) of residual austenite, with the balance being stable martensite, and the subsequent tempering transforms the martensite into the desirable sorbite in which carbides are completely precipitated. It follows that the resulting steel has both high strength and high toughness.

According to the present invention, hardening is accomplished in two steps. The first step is the conventional oil hardening which brings about the martensitic transformation, with some austenite remaining unchanged. The cooling medium used for this hardening includes a variety of conventional hardening oils as well as aqueous oil emulsions. The optimum hardening temperature is in the neighborhood of 80° C., which is higher than the $Ac_3$ transformation point of steel.

It is desirable that the steel be wiped clean of oil by brushing after the oil hardening. Oil remaining on the surface of the steel wire may have an adverse effect on the subsequent water hardening.

The oil hardening (as the first step) is immediately followed by the water hardening (as the second step), which is intended to cool the steel below the Mf point at an adequate water temperature (cooling rate). This water hardening gives rise to stable martensite sufficiently (with a small amount of austenite remaining). The optimum amount of martensite for individual steels (having different Mf points) can be controlled according to the water hardening temperature.

The water hardening (as the second step) is followed immediately by tempering at 300°–500° C. as in the conventional method. The tempering gives rise to sorbite which is most suitable for high-strength high-toughness springs.

The continuous heat treatments according to the present invention may be applied to steel in the form of wire (not springs) as well as in the form of hot-formed springs. In the former case, steel wires undergo the two-step hardening and the subsequent tempering, and the tempered steel wires are formed into springs. In the latter case, springs undergo the two-step hardening and the subsequent tempering.

BEST MODE FOR CARRYING OUT THE INVENTION

The invention will be described in more detail with reference to the following example, which is not intended to restrict the scope of the invention.

EXAMPLE

A steel having the chemical composition and Mf point as shown in Table 1 was made into a steel wire (11.0 mm in diameter) for springs by melting, casting, and drawing in the usual way. The steel wire underwent hardening and tempering continuously under the conditions shown in Table 2. The heat-treated steel wire was tested for mechanical properties. The results are shown in Table 3.

It is noted from Table 3 that the two-step accelerated hardening according to the present invention gives rise to sufficient martensite, particularly in the case of alloy steel having a low Mf point, which, upon tempering, has high toughness (represented by the reduction of area greater than about 20%) and high strength (represented by the tensile strength of about 2000 $N/mm^2$). It was confirmed that the thus obtained steel wire can be fabricated into springs having both high strength and high toughness. It is to be noted that the conventional method (in which hardening is by oil hardening alone) does not provide sufficient strength not only in the case of carbon steel but also in the case of alloy steels having a low Mf point.

INDUSTRIAL APPLICATION

As mentioned above, the method of the present invention, which consists of two-step accelerated hardening and tempering, can be advantageously applied to medium carbon low alloy steel wire for springs. The resulting tempered steel wire can be fabricated into springs having both high strength and high toughness. Therefore, the present invention greatly contributes to raising the strength of springs to meet the necessity for weight reduction.

TABLE 1

| Designation of Steel | Chemical composition of steel (wt %) | | | | | | | | | MI (°C.) |
|---|---|---|---|---|---|---|---|---|---|---|
| | C | Si | Mn | P | S | Ni | Cr | Mo | V | |
| A | 0.60 | 1.65 | 0.85 | 0.007 | 0.007 | 0.01 | — | — | — | 56 |
| B | 0.55 | 1.40 | 0.70 | 0.007 | 0.007 | 0.01 | 0.70 | — | — | 64 |
| C | 0.60 | 1.45 | 0.45 | 0.007 | 0.007 | 0.01 | 0.60 | — | 0.175 | 52 |
| D | 0.59 | 1.70 | 0.40 | 0.008 | 0.004 | 0.10 | 0.69 | — | 0.172 | 50 |
| E | 0.49 | 2.06 | 1.03 | 0.007 | 0.003 | 1.99 | 1.05 | 0.21 | 0.210 | 22 |

TABLE 2

| Heat treatment | Designation of steel | Heating temperature (°C.) | Temperature after oil hardening (°C.) | Cooling rate (°C./min) | Temperature after water hardening (°C.) | Cooling rate (°C./min) | Amount of martensite after water hardening (%) | Tempering temperature (°C.) |
|---|---|---|---|---|---|---|---|---|
| Conventional method | A | 940 | 80 | 500 | — | — | 91 | 460 |
| | B | 940 | 80 | 500 | — | — | 92 | 460 |
| | C | 940 | 80 | 500 | — | — | 90 | 460 |
| | D | 940 | 80 | 500 | — | — | 90 | 460 |
| | E | 940 | 80 | 500 | — | — | 82 | 460 |
| Method of the present Invention | A | 940 | 80 | 500 | 25 | 100 | 96 | 460 |
| | B | 940 | 80 | 500 | 25 | 100 | 96 | 460 |
| | C | 940 | 80 | 500 | 25 | 100 | 95 | 460 |
| | D | 940 | 80 | 500 | 25 | 100 | 94 | 460 |
| | E | 940 | 80 | 500 | 25 | 100 | 92 | 460 |

TABLE 3

| Heat treatment | Designation of steel | Tensile strength ($N/mm^2$) | Reduction of area (%) | Results of bend test |
|---|---|---|---|---|
| Conventional method | A | 1814 | 43.0 | good |
| | B | 1765 | 44.5 | good |
| | C | 1888 | 35.5 | good |
| | D | 1907 | 21.5 | good |
| | E | 1873 | 30.5 | good |
| Method of the present invention | A | 1853 | 39.5 | good |
| | B | 1824 | 40.5 | good |
| | C | 1956 | 38.0 | good |
| | D | 2001 | 35.5 | good |
| | E | 2005 | 38.0 | good |

We claim:

1. An improved method for continuously hardening and tempering oil-tempered steel wires for springs having high strength and high toughness, comprising heating at an elevated temperature a medium carbon low alloy spring steel having a chemical composition corresponding to an Mf point lower than 80° C., containing carbon in amount of 0.40–0.65 mass %, Si, Mn, and at least one species selected from the group consisting of Cr, Ni, Mo and V, and which does not undergo martensitic transformation substantially upon oil hardening alone, performing a two-step accelerated hardening consisting of subjecting the heated spring steel to oil hardening, wiping oil from the steel, immediately followed by water hardening to produce a hardened steel, and subsequently performing tempering on the hardened steel to produce a tempered steel.

2. The method as defined in claim 1, wherein the medium carbon low alloy steel has a chemical composition corresponding to an Mf point of from 10° C. to 70° C.

3. The method as defined in claim 1, wherein the two-step accelerated hardening is performed such that the hardened steel is composed mostly of stable martensite, with the balance being less than 10% of residual austenite, and the tempering is performed such that the tempered steel is composed of sorbite.

4. The method as defined in claim 1, wherein the tempering is performed at a temperature in the range of 300° C. to 500° C.

* * * * *